US006196904B1

(12) United States Patent
Matsuo et al.

(10) Patent No.: US 6,196,904 B1
(45) Date of Patent: Mar. 6, 2001

(54) POLISHING APPARATUS

(75) Inventors: Hisanori Matsuo, Fujisawa; Hirokuni Hiyama, Tokyo; Yutaka Wada; Kazuto Hirokawa, both of Chigasaki, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/276,148

(22) Filed: Mar. 25, 1999

(30) Foreign Application Priority Data

Mar. 25, 1998 (JP) ..... 10-096884

(51) Int. Cl.[7] ..... B24B 1/00
(52) U.S. Cl. ..... 451/288; 451/285
(58) Field of Search ..... 451/285, 287, 451/288

(56) References Cited

U.S. PATENT DOCUMENTS 3,841,031 * 10/1974 Walsh ..... 451/288 X
3,968,598 * 7/1976 Ogawa ..... 451/288 X
5,441,444 * 8/1995 Nakajima ..... 451/288 X
5,624,299 * 4/1997 Shendon ..... 451/288 X
5,643,061 * 7/1997 Jackson et al. ..... 451/288 X
5,679,064 * 10/1997 Nishi et al. ..... 451/288
5,716,264 * 2/1998 Kimura et al. ..... 451/289 X
5,795,215 * 8/1998 Guthrie et al. ..... 451/285 X
5,916,412 4/1999 Nakashiba et al. .

* cited by examiner

*Primary Examiner*—David A. Scherbel
*Assistant Examiner*—Anthony Ojini
(74) *Attorney, Agent, or Firm*—Wenderoth, Lind & Ponack, L.L.P.

(57) ABSTRACT

A polishing apparatus polishes a workpiece to a planar mirror finish stably, and is prevented from being vibrated while polishing is carried out. The polishing apparatus has a rotatable holding member for holding the workpiece, and a bearing supporting an outer circumferential surface of the holding member, for suppressing vibrations transmitted to the holder while the workpiece is being polished.

10 Claims, 9 Drawing Sheets

POLISHING APPARATUS

BACKGROUND OF THE INVENTION

1. Field of the Invention

The present invention relates to a polishing apparatus for polishing a workpiece such as a semiconductor wafer to a planar mirror finish, and more particularly to a polishing apparatus for polishing a workpiece by pressing a polishing pad or a grinding plate and the workpiece against each other while moving them in sliding contact with each other.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithography process can form narrower interconnections, it requires that surfaces on which pattern images are to be focused by a stepper be as flat as possible because the depth of focus of the optical system is relatively small. It is therefore necessary to make the surfaces of semiconductor wafers flat for photolithography. One customary way of flattening the surface of semiconductor wafers has been to polish semiconductor wafers by polishing apparatus.

Heretofore, polishing apparatus for polishing semiconductor wafers comprises a turntable with a polishing pad attached thereto and a top ring for holding a semiconductor wafer to be polished. The top ring which holds a semiconductor wafer to be polished presses the semiconductor wafer against the polishing pad on the turntable. While an abrasive liquid is being supplied to the polishing pad, the top ring and the turntable are rotated about their own axes to polish the surface of the semiconductor wafer to a planar mirror finish.

FIG. 1 of the accompanying drawings shows a conventional polishing apparatus. As shown in FIG. 1, the conventional polishing apparatus comprises a turntable 5 with a polishing pad 6 attached to an upper surface thereof, a top ring 1 for holding a semiconductor wafer 4 which is a workpiece to be polished while rotating and pressing the semiconductor wafer 4 against the polishing pad 6, and an abrasive liquid supply nozzle 9 for supplying an abrasive liquid Q to the polishing pad 6. The upper surface of the polishing pad 6 provides a polishing surface. The top ring 1 is connected to a top ring drive shaft 8, and supports on its lower surface a resilient mat 2 such as of polyurethane or the like. The semiconductor wafer 4 is held on the top ring 1 in contact with the resilient mat 2. The top ring 1 also has a cylindrical guide ring 3 mounted on a lower outer circumferential surface thereof for preventing the semiconductor wafer 4 from being disengaged from the lower surface of the top ring 1 while the semiconductor wafer 4 is being polished. The guide ring 3 is fixed to the top ring 1 against relative movement in the circumferential direction. The guide ring 3 has a lower end projecting downwardly beyond the lower supporting surface of the top ring 1. The guide ring 3 holds the semiconductor wafer 4 on the lower supporting surface of the top ring 1 against dislodgment from the top ring 1 due to frictional forces developed between the semiconductor wafer 4 and the polishing pad 6 while the semiconductor wafer 4 is being polished.

In operation, the semiconductor wafer 4 is held against the lower surface of the resilient mat 2 on the top ring 1, and pressed against the polishing pad 6 by the top ring 1. The turntable 5 and the top ring 1 are rotated about their own axes to move the polishing pad 6 and the semiconductor wafer 4 relatively to each other in sliding contact for thereby polishing the semiconductor wafer 4. At this time, the abrasive liquid Q is supplied from the abrasive liquid supply nozzle 9 to the polishing pad 6. The abrasive liquid Q comprises, for example, an alkaline solution with fine abrasive grain particles suspended therein. Therefore, the semiconductor wafer 4 is polished by both a chemical action of the alkaline solution and a mechanical action of the fine abrasive grain particles. Such a polishing process is referred to as a chemical and mechanical polishing (CMP) process.

Another known polishing apparatus employs a grinding plate made of abrasive grain particles bonded by a synthetic resin for polishing a workpiece. The grinding plate is mounted on the turntable, and an upper surface of the grinding plate provides a polishing surface. Since this polishing apparatus does not employ a soft polishing pad and a slurry-like abrasive liquid, it can polish the workpiece to a highly accurate finish. The polishing process by the grinding plate is also advantageous in that it is less harmful to the environment because it discharges no waste abrasive liquid.

The conventional polishing apparatus shown in FIG. 1 has a spherical bearing 7 positioned between the top ring 1 and the top ring drive shaft 8. The spherical bearing 7 allows the top ring 1 to be tilted quickly with respect to the top ring drive shaft 8 even when the top ring 1 encounters a small slant on the upper surface of the turntable 5. The top ring drive shaft 8 is kept in driving engagement with the top ring 1 by a torque transmission pin 107 on the top ring drive shaft 8 and torque transmission pins 108 on the top ring 1. The torque transmission pins 107, 108 are held in sliding point-to-point contact with each other. When the top ring 1 is tilted with respect to the top ring drive shaft 8, the torque of the top ring drive shaft 8 is smoothly and reliably transmitted to the top ring 1 because the torque transmission pins 107, 108 change their point of contact while transmitting the torque.

The above conventional polishing apparatus are problematic in that while polishing a workpiece, the polishing apparatus suffer large vibrations owing to frictional forces developed between the turntable and the top ring with the workpiece interposed therebetween. An analysis suggests that such large vibrations are caused by a combined action of resistant forces by the rotating top ring and the rotating turntable which are rotated independently of each other, such resistant forces being dependent on frictional forces developed between the surface of the workpiece and the surface of the polishing pad or grinding plate, and restoring forces exerted by the top ring drive shaft and a turntable drive shaft.

When the vibrations become large, the polished surface of the workpiece develops polish irregularities or scratches or other surface damage, and hence the workpiece cannot be polished stably. The vibrations may become so intensive that the workpiece may be forcibly detached from the top ring and no longer will be polished.

SUMMARY OF THE INVENTION

It is therefore an object of the present invention to provide a polishing apparatus which is capable of preventing undue vibrations during a polishing process and of stably polishing a workpiece to a planar mirror finish.

According to the present invention, there is provided a polishing apparatus for polishing a workpiece to a planar mirror finish by pressing the workpiece against a polishing surface while keeping the workpiece and the polishing surface in sliding motion, comprising a holding member for holding the workpiece, a mechanism for rotating the holding member, and a bearing supporting an outer circumferential surface of the holding member, for suppressing vibrations transmitted to the holder while the workpiece is being polished.

The outer circumferential surface of the holding member which holds the workpiece to be polished is rotatably supported by the bearing for suppressing vibrations of the holding member. Vibrations produced owing to a combined action of frictional forces developed on the surface being polished and restoring forces exerted by drive shafts of the holding member and the abrasive member, are maximized on the holding member supported by the drive shaft which is relatively small in diameter. Therefore, since the holding member is rotatably supported at its outer circumferential surface by the bearing, vibrations of the holding member are suppressed, and hence vibrations of the polishing apparatus in its entirety are also suppressed. Consequently, even when the rotational speeds of the workpiece and the abrasive member increase or the pressure applied therebetween increases to develop a buildup of frictional force, the polishing apparatus is effectively prevented from being unduly vibrated, and can polish the workpiece stably under desired operating conditions.

As described above, vibrations of the holding member can be suppressed because the holding member is rotated with its outer circumferential surface being rotatably supported by the bearing. This structure is also applicable to other polishing apparatus than polishing apparatus which have a top ring and a turntable. Specifically, the structural details are applicable to a cup-type polishing apparatus in which the workpiece is arranged with its surface to be polished facing upwardly and the abrasive member rotates and presses against the workpiece, and also to a scrolling-type polishing apparatus in which the grinding plate or polishing pad is arranged with its polishing surface facing upwardly and the workpiece is arranged with its surface to be polished facing downwardly against the grinding plate or polishing pad, which is caused to make a scrolling motion such as circulate orbital motion to polish the workpiece.

The bearing may comprise a mechanical bearing or a non-contact-type bearing such as a magnetic bearing.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
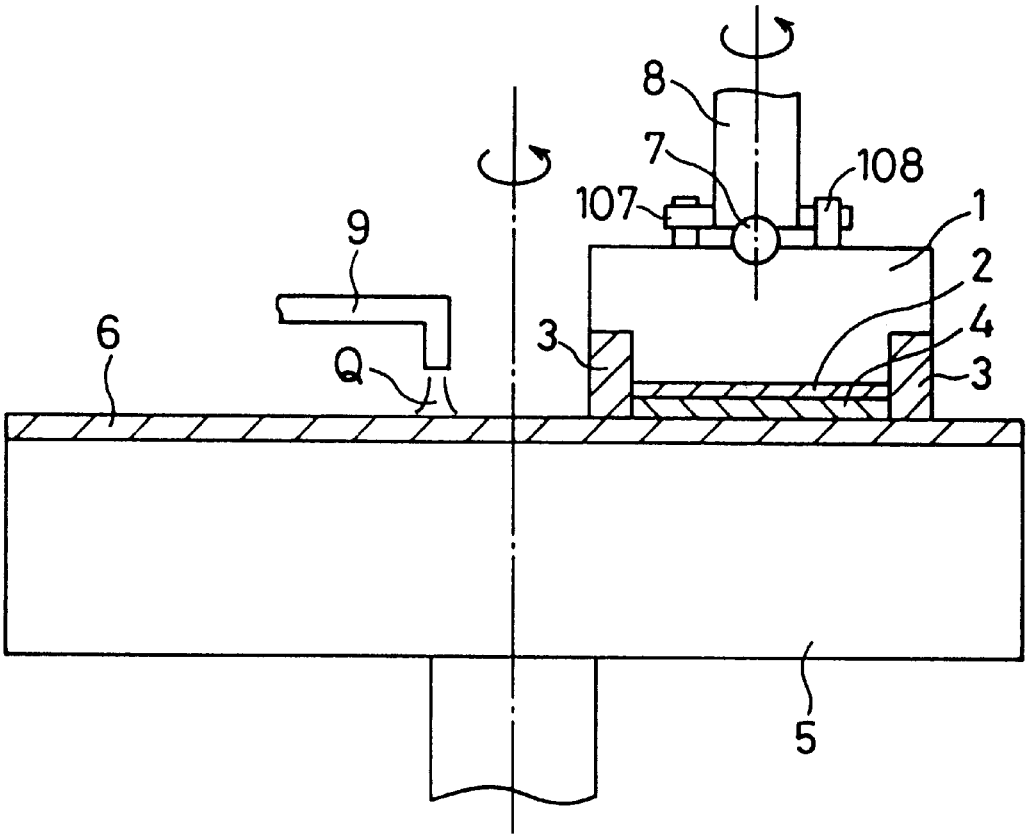
F I G. 1 PRIOR ART
FIG. 1 is a vertical cross-sectional view of a conventional polishing apparatus.

Like or corresponding parts are denoted by like or corresponding reference numerals throughout views.

Figure 2:
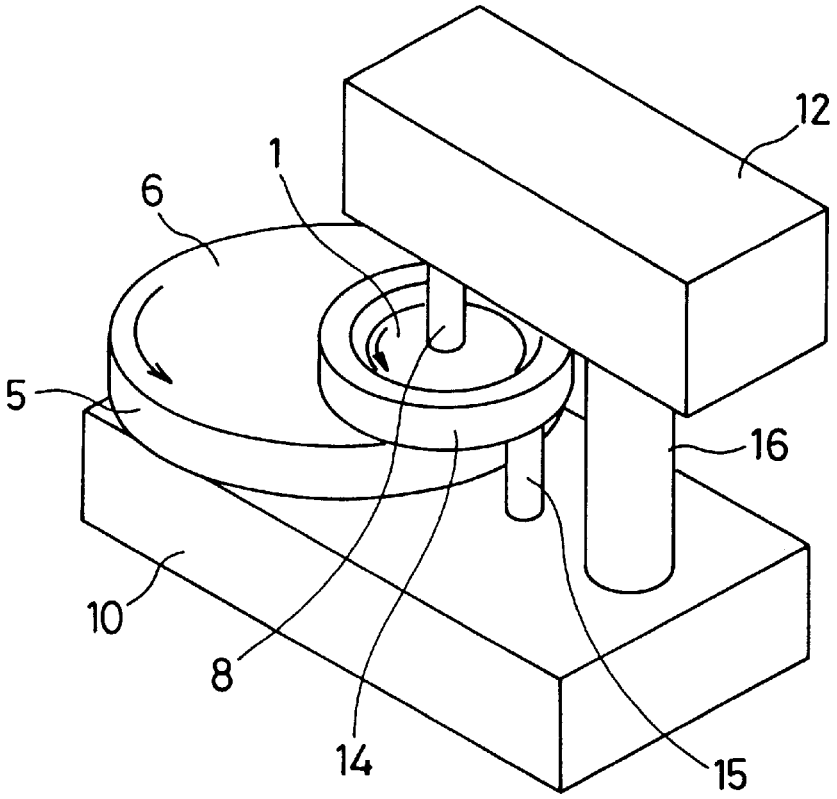
FIG. 2 is a perspective view of a polishing apparatus according to a first embodiment of the present invention.
Figure 3:
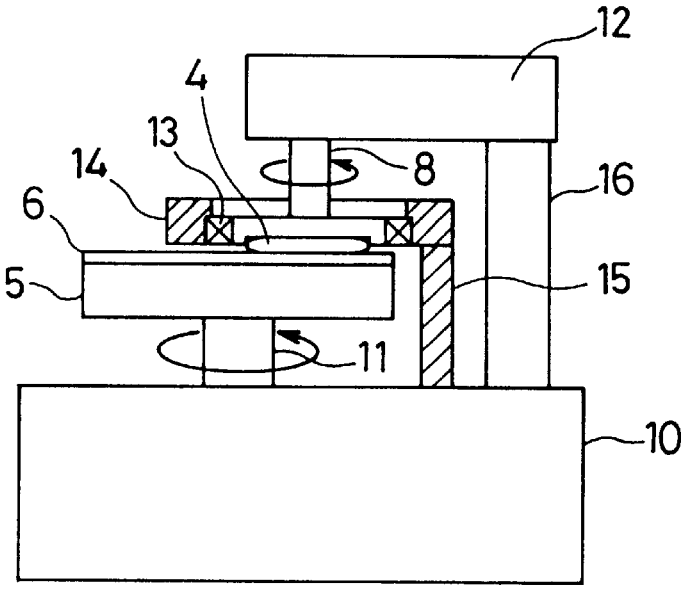
FIG. 3 is a vertical cross-sectional view of the polishing apparatus shown in FIG. 2.

As shown in FIGS. 2 and 3, a polishing apparatus according to a first embodiment of the present invention generally comprises a turntable 5 with a polishing pad or grinding plate 6 attached to an upper surface thereof and a top ring 1 for holding a semiconductor wafer 4 which is a workpiece to be polished. The upper surface of the polishing pad or the grinding plate provides a polishing surface. The turntable 5 is fixed to the upper end of a vertical drive shaft 11 which is rotatably supported by bearings (not shown) in a mount base 10 and can be rotated by a motor and a belt-and-pulley mechanism (not shown). The top ring 1 is fixed to the lower end of a vertical drive shaft 8 which can be rotated by a motor and a belt-and-pulley mechanism (not shown) that are housed in a top ring casing 12. The top ring casing 12 also houses bearings by which the drive shaft 8 is rotatably supported, and a presser mechanism such as an air cylinder or the like for pressing the top ring 1 toward the turntable 5. Therefore, the top ring 1 can be pressed against the turntable 5 while being rotatably supported by the drive shaft 8. The top ring casing 12 is supported on the mount base 10 by a vertical support shaft 16. The top ring 1 comprises a disk-shaped element which holds on its lower surface the semiconductor wafer 4 to be polished.

The top ring 1 has its outer circumferential surface supported by a bearing 13 housed in a bearing casing 14. The bearing casing 14 is detachably fixed to the mount base 10 by a vertical post 15.

The polishing apparatus shown in FIGS. 2 and 3 operates as follows:

The semiconductor wafer 4 is attracted to and held in a recess in the lower surface of the top ring 1 by a suction force or the like. The top ring 1 holding the semiconductor wafer 4 is moved to a position over the turntable 5, and lowered to bring the semiconductor wafer 4 into contact with the polishing pad or grinding plate 6 on the turntable 5. The bearing casing 14 is fixed to the support post 15 and firmly fixed to the mount base 10.

The turntable 5 and the top ring 1 start being independently rotated about their own axes up to a predetermined speed, and the top ring 1 is lowered to press the lower surface of the wafer 4 to be polished against the polishing pad or grinding plate 6 under a predetermined pressure. If the polishing pad is employed on the turntable 5, then an abrasive liquid is supplied onto the polishing pad, and the lower surface of the semiconductor wafer 4 is polished by abrasive grain particles contained in the abrasive liquid. If the grinding plate is employed on the turntable 5, then the lower surface of the semiconductor wafer 4 is polished by abrasive grains produced and contained in the grinding plate. It is preferable that the turntable 5 and the top ring 1 be rotated at the same speed for uniformly polishing the entire lower surface of the semiconductor wafer 4.

As the speed of the turntable 5 and the top ring 1 increases, the rate at which the semiconductor wafer 4 is polished increases. The rate of polishing is also increased when the pressure under which the semiconductor wafer 4 is pressed against the polishing pad or grinding plate 6 by the top ring 1 increases. However, an increase in the rotational speed of the turntable 5 and the top ring 1 or an increase in the pressure applied to the semiconductor wafer 4 by the top ring 1 tends to cause the polishing apparatus to vibrate in its entirety. Such vibrations of the polishing apparatus would be liable to increase because the drive shaft 8 of the top ring 1 is usually relatively small in diameter.

According to the embodiment shown in FIGS. 2 and 3, the outer circumferential surface of the top ring 1 is rotatably secured firmly to the mount base 10 by the bearing 13. Since the top ring 1 is firmly supported on the mount base 10, i.e., the bearing casing 14 is fixed to the mount base 10, it is effectively prevented from vibrating. Therefore, the top ring casing 12 and the support shaft 16 are also prevented from vibrating, and hence the turntable 5 and the drive shaft 11 are also prevented from vibrating.

Figure 4:
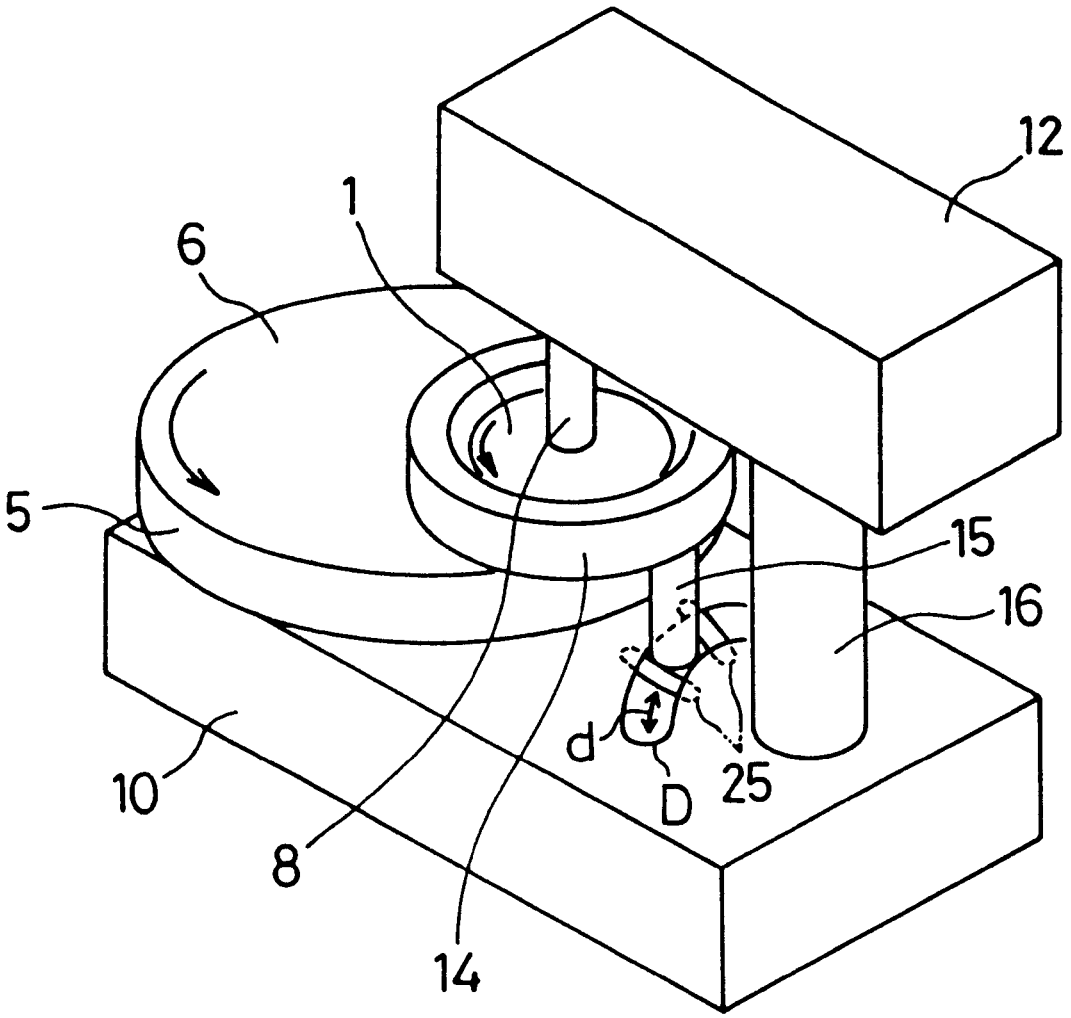
FIG. 4 a perspective view of a modification of the polishing apparatus shown in FIG. 2.

FIG. 4 shows a modification of the polishing apparatus according to the first embodiment shown in FIGS. 2 and 3.

According to the modification shown in FIG. 4, the support post 15 is swingably supported on the mount base 10. While the semiconductor wafer is not polished by the polishing apparatus, the support post 15 is swingable to retract the bearing casing 14 away from the position above the turntable 5. Specifically, the mount base 10 has a swing slot D defined therein, and the support post 15 is movably disposed in the swing slot D. When the support post 15 moves along the swing slot D in either of the directions indicated by the arrow d, the bearing casing 14 is allowed to swing in unison with the top ring 1. The swing slot D is defined as an arcuate slot extending about the axis of the support shaft 16 and having a radius of curvature equal to the distance from the support shaft 16 to the support post 15. While a semiconductor wafer is being polished by the polishing apparatus, the support post 15 is firmly fixed to the mount base 10 by a pair of stop bars 25 extending across the swing slot D in sandwiching relation to the support post 15. When the polishing of the semiconductor wafer is finished, the stop bars 25 are retracted out of the swing slot D, and the support post 15 is moved along the swing slot D to retract the bearing casing 14 and the top ring 1 away from the turntable 5. In this manner, the semiconductor wafer 4 which has been kept in close contact with the polishing pad or grinding plate 6 on the turntable 5 during the polishing process can easily be lifted off and moved away.

Figure 5:
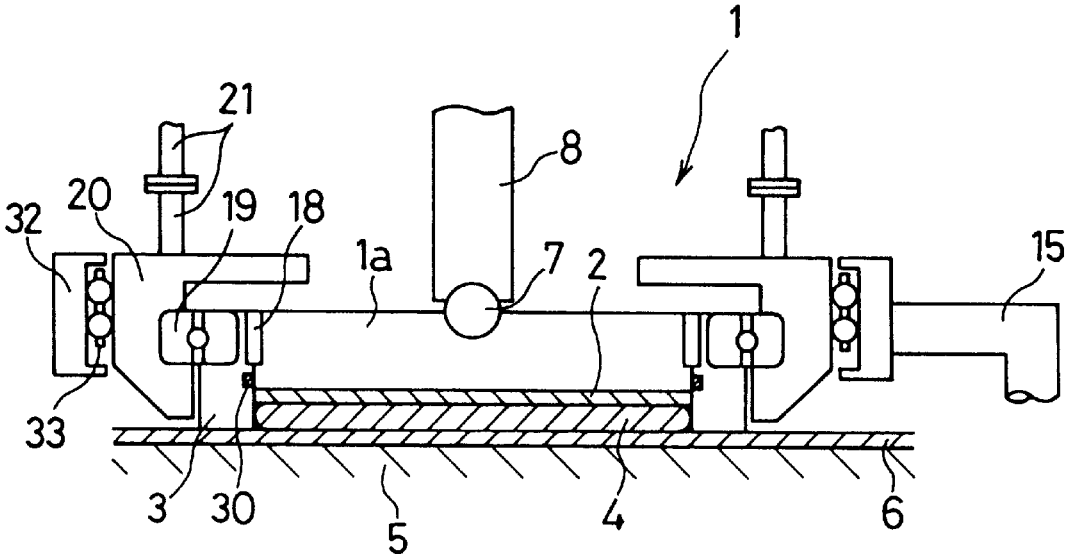
FIG. 5 is a vertical cross-sectional view showing in detail one example of a top ring of the polishing apparatus shown in FIGS. 2 and 4.

FIG. 5 shows in detail an example of the top ring 1 of the polishing apparatus shown in FIGS. 2 and 4. The top ring 1 has a top ring body 1*a* which supports on its lower surface a resilient mat 2 such as of polyurethane or the like. The top ring 1 has a cylindrical guide ring 3 mounted on a lower outer circumferential surface of the top ring body 1*a* for preventing the semiconductor wafer 4 from being disengaged from the lower surface of the top ring body 1*a* while the semiconductor wafer 4 is being polished. The semiconductor wafer 4 is retained in a recess surrounded by the guide ring 3 and the resilient mat 2. The surface, to be polished, of the semiconductor wafer 4 is held in contact with the polishing pad or grinding plate 6.

The top ring body 1*a* is connected to the drive shaft 8 by a spherical bearing 7. The drive shaft 8 can be rotated by a rotating mechanism comprising a motor and a belt-and-pulley mechanism (not shown) which are housed in the top ring casing 12, for thereby rotating the top ring body 1*a* by torque transmission pins such as shown in FIG. 1. The drive shaft 8 can also be lowered by a presser mechanism such as an air cylinder or the like housed in the top ring casing 12, for thereby pressing the top ring body 1*a* toward the turntable 5. The semiconductor wafer 4 held on the lower surface of the top ring body 1*a* is polished while it is being rotated in sliding motion with respect to the polishing pad or grinding plate 6 and also being pressed against the polishing pad or grinding plate 6.

The guide ring 3 is coupled to the top ring body 1*a* by keys 18 such that the guide ring 3 is vertically movable with respect to the top ring body 1*a* and rotatable in unison with the top ring body 1*a*. The guide ring 3 is coupled to a guide ring presser 20 by a guide ring bearing 19 such that the guide ring 3 is rotatable in a horizontal plane with respect to the guide ring presser 20 and vertically movable in unison with the guide ring presser 20. Specifically, the guide ring bearing 19 has an inner race mounted on an outer circumferential surface of the guide ring 3 and an outer race mounted on an inner circumferential surface of the guide ring presser 20. The guide ring presser 20 is connected to the air cylinder or the like in the top ring casing 12 by vertical shafts 21. Therefore, the guide ring presser 20, when lowered by the air cylinder or the like, can press the guide ring 3 down against the polishing pad or grinding plate 6. The guide ring presser 20 has its outer circumferential surface supported by a bearing 33 housed in a bearing casing 32 which is firmly secured to the mount base 10 by the support post 15. A vibration damper 30 such as an O-ring is interposed between the top ring body 1*a* and the guide ring 3 for absorbing vibrations generated while the semiconductor wafer 4 is being polished.

Even when vibrations are developed by a combined action of frictional forces developed between the surface of the semiconductor wafer 4 and the surface of the polishing pad or grinding plate 6 and restoring forces exerted by the drive shafts 8, 11, such vibrations are first absorbed by the resilient mat 2 and then by the vibration damper 30 interposed between the top ring 1 and the guide ring 3. Greater vibrations are transmitted from the surface of the semiconductor wafer 4 via the resilient mat 2, the top ring 1, and the keys 18 to the guide ring 3. However, since the guide ring 3 is rotatably supported by the bearing 33 housed in a bearing case 32 which is firmly secured to the mount base 10 by the support post 15, such greater vibrations are suppressed by the bearing 33.

In FIG. 5, the bearings 19, 33 are illustrated as comprising ball bearings. However the bearings 19, 33 may comprise plain bearings. In the illustrated embodiment, the guide ring 3 is supported by the bearing 19. However, the top ring body 1*a* itself may be supported directly by a bearing. In the illustrated embodiment, the top ring body 1*a* is connected to the drive shaft 8 by the spherical bearing 7. However, the top ring body 1*a* may be coupled directly to the drive shaft 8.

In the illustrated embodiment, the bearing 33 is fixed to the mount base 10. However, the bearing 33 may be fixed to a different member, other than the top ring casing 12, which is less subject to vibrations of the top ring 1.

Figure 6:
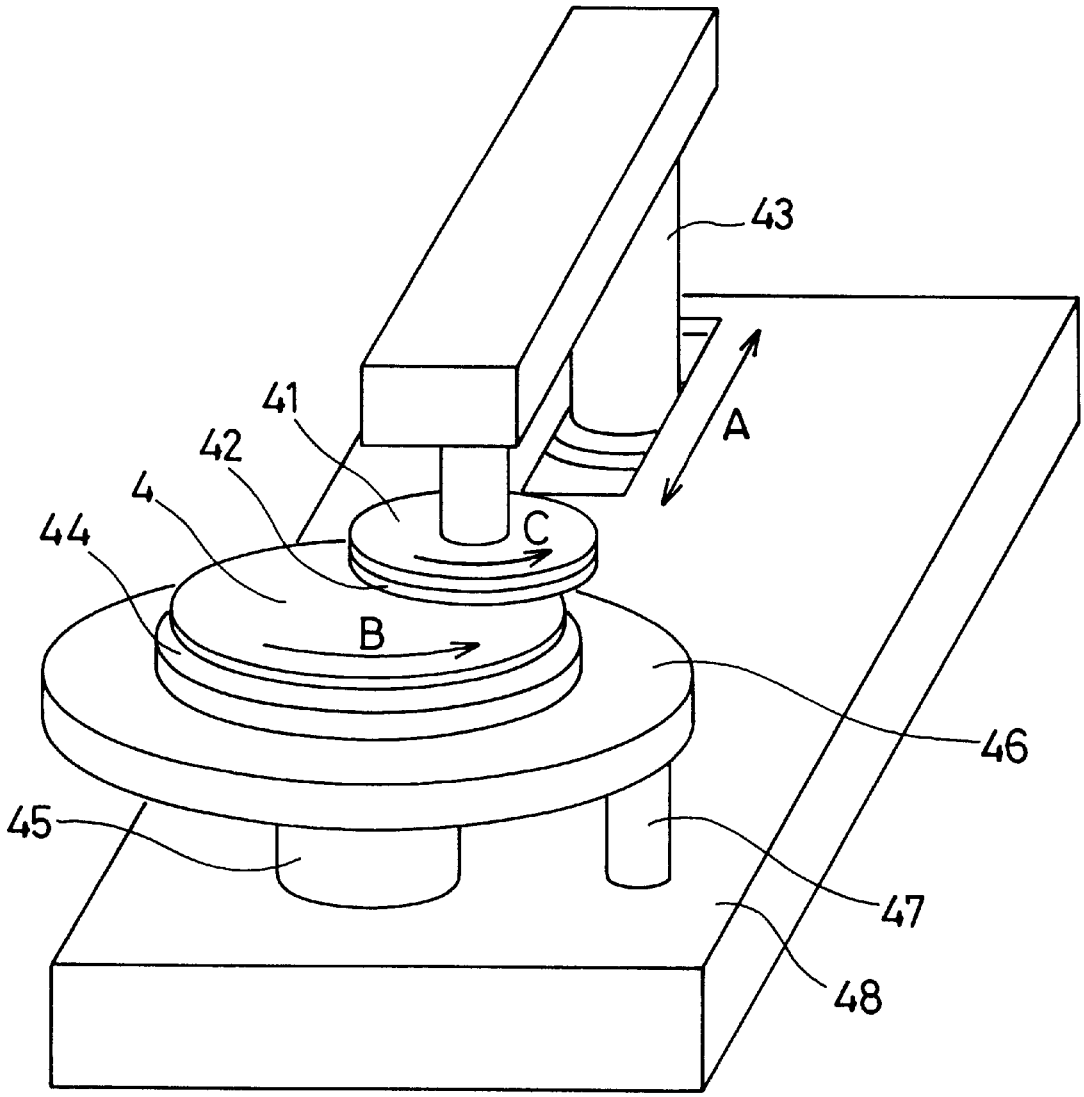
FIG. 6 is a perspective view of a polishing apparatus according to a second embodiment of the present invention.

FIG. 6 shows a polishing apparatus according to the second embodiment of the present invention. The polishing apparatus shown in FIG. 6 is of a cup-type configuration. As shown in FIG. 6, a grinding wheel holder 41 supports a ring-shaped grinding wheel 42 fixed to its lower surface. The grinding wheel holder 41 is actuated by a drive mechanism 43 to press the ring-shaped grinding wheel 42 against a semiconductor wafer 4. The drive mechanism 43 is reciprocally movable in the directions indicated by the arrow A while the semiconductor wafer 4 is being polished by the ring-shaped grinding plate 42. While the grinding plate 42 is ring shaped in the illustrated embodiment, it may comprise an annular array of small disk-shaped grinding members. The semiconductor wafer 4 is supported on a wafer holder 44 which is rotatable about its own axis in the direction indicated by the arrow B. The wafer holder 44 is fixedly mounted on a support shaft 45, which is rotatable by a motor (not shown) housed in a mount base 48 thereby to rotate the semiconductor wafer 4. The wafer holder 44 has an outer circumferential surface rotatably supported by a bearing (not shown) housed in a bearing case 46. The bearing case 46 is firmly fixed to the mount base 48 by a support post 47. Vibrations developed while the semiconductor wafer 4 is being polished are suppressed because the outer circumferential surface of the wafer holder 44 is supported by the bearing.

Figure 7:
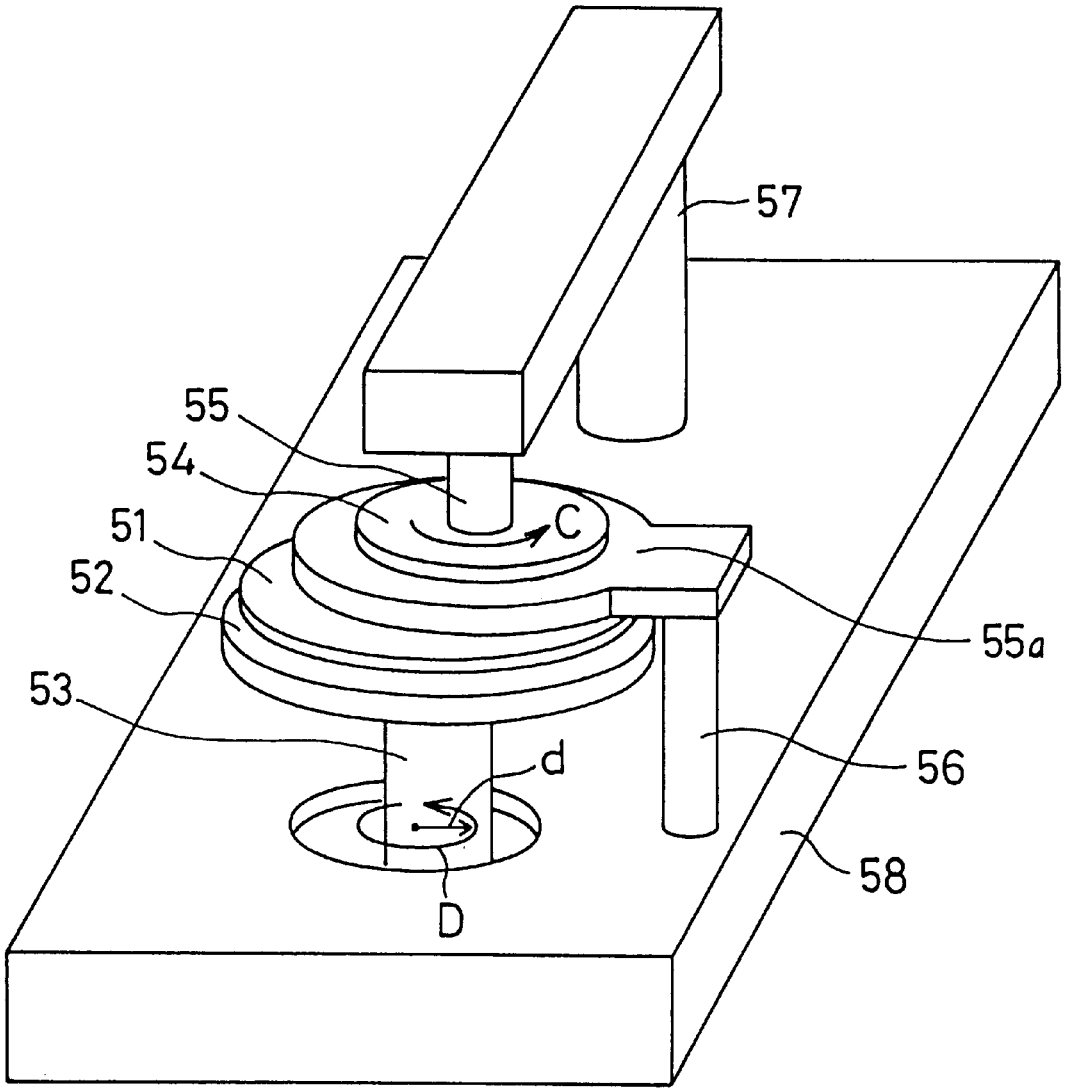
FIG. 7 is a perspective view of a polishing apparatus according to a third embodiment of the present invention.

FIG. 7 shows a polishing apparatus according to the third embodiment of the present invention. The polishing apparatus shown in FIG. 7 is of a scrolling-type configuration. As shown in FIG. 7, a holder 52 with a grinding plate or polishing pad 51 attached thereto is supported on a support shaft 53 which can be driven to make a scrolling motion in the direction indicated by the arrow D. The term "scrolling motion" used herein means a circulatory rotating orbital motion having a radius "d" imparted to the grinding plate or polishing pad 51 while the grinding plate or polishing pad 51 is being translated. A wafer holder 54 for holding a semiconductor wafer (not shown) is fixed to a support shaft 55 which can be rotated in the direction indicated by the arrow C by a drive mechanism 57. The wafer holder 54 has an outer circumferential surface rotatably supported by a bearing (not shown) housed in a bearing case 55*a*. The wafer holder 54 is thus rotatably supported while being prevented from radial movement. The bearing case 55*a* is firmly fixed to a mount base 58 by a support post 56. The grinding plate or polishing pad 51 held by the holder 52 has its grinding or polishing surface facing upwardly, and the semiconductor wafer is held by the wafer holder 54 with its surface, to be polished, facing downwardly. The semiconductor wafer is rotated by the drive mechanism 57 and pressed against the grinding plate or polishing pad 51. The semiconductor wafer is polished as the grinding plate or polishing pad 51 makes the scrolling motion and the semiconductor wafer is rotated and pressed against the grinding plate or polishing pad 51. Even when vibrations are developed by a combined action of frictional forces developed between the surface of the semiconductor wafer and the surface of the grinding plate or polishing pad 51 and restoring forces exerted by the support shaft 55, such vibrations are suppressed because the wafer holder 54 is rotatably supported by the bearing in the bearing case 55*a*.

Figure 8:
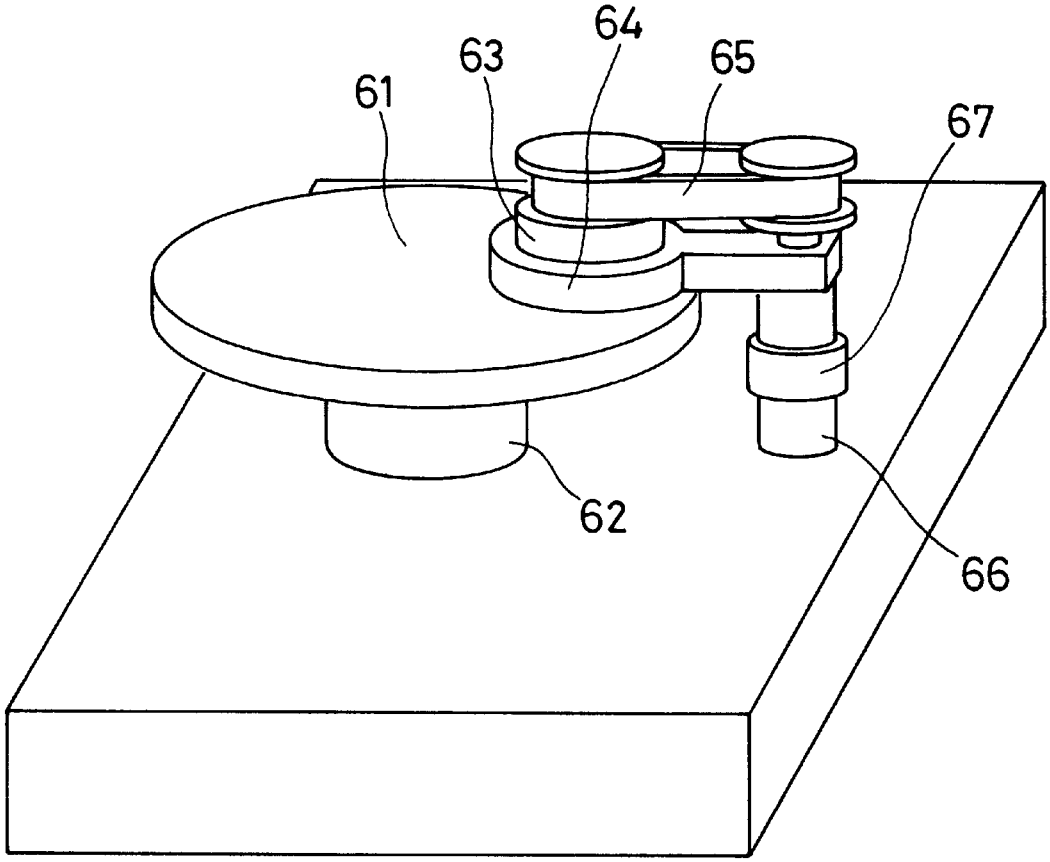
FIG. 8 is a perspective view of a polishing apparatus according to a fourth embodiment of the present invention.
Figure 9:
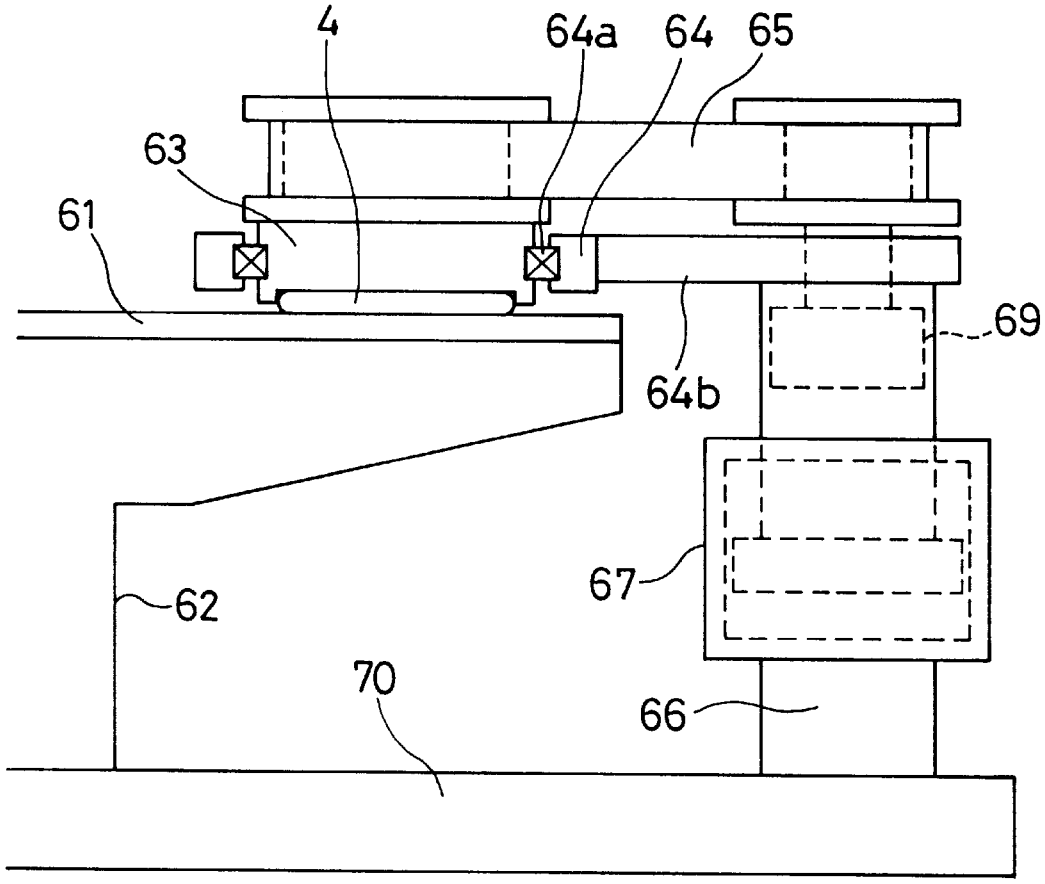
FIG. 9 is a fragmentary vertical cross-sectional view of a portion of the polishing apparatus shown in FIG. 8.

FIGS. 8 and 9 show a polishing apparatus according to the fourth embodiment of the present invention. The polishing apparatus shown in FIGS. 8 and 9 is free of a top ring shaft and top ring support arm. The polishing apparatus has a grinding plate or polishing pad 61 mounted on a turntable rotatably supported by a support shaft 62. A semiconductor wafer 4 to be polished is held by a top ring 63 which has no support shaft and no top ring support arm, and pressed against the grinding plate or polishing pad 61. The top ring 63 has its outer circumferential surface rotatably supported by a bearing 64*a* housed in a bearing case 64. The bearing case 64 is fixed to a mount base 70 by an arm 64*b* and a support post 66. The top ring 63 is rotatable by a motor 69 disposed in the support post 66 via a belt 65. The support post 66 also houses a pressing cylinder 67 for lowering the bearing case 64 to impose a vertical load on the surface, to be polished, of the semiconductor wafer 4. Vibrations developed by the semiconductor wafer 4 being polished and transmitted to the top ring 63 are suppressed because the outer circumferential surface of the top ring 63 is rotatably supported by the bearing 64*a* housed in the bearing case 64. In this embodiment, because the top ring 63 is rotatably supported by the bearing, which is fixed to the mount base, a top ring support arm 12 such as shown in FIG. 2 is not necessary. Therefore, the size of the polishing apparatus becomes compact in height.

Figure 10:
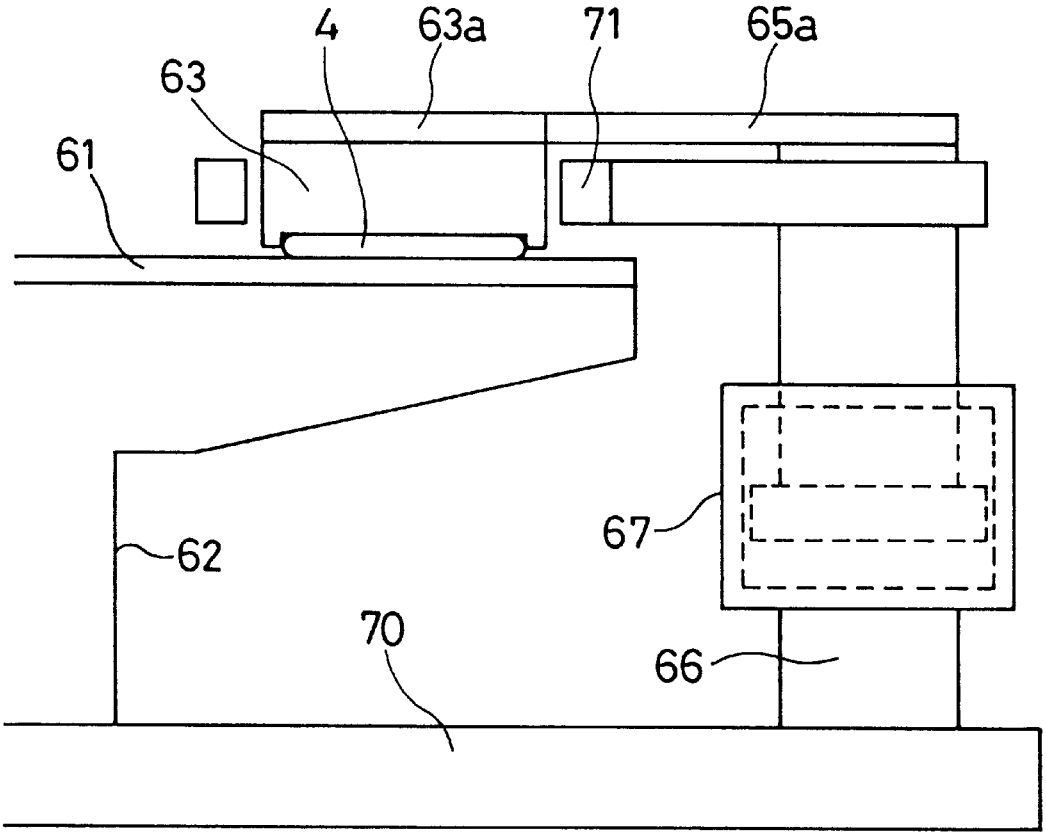
FIG. 10 is a fragmentary vertical cross-sectional view of a modification of the polishing apparatus shown in FIGS. 8 and 9.

FIG. 10 shows a modification of the polishing apparatus according to the fourth embodiment shown in FIGS. 8 and 9. The modified apparatus has a magnetic bearing 71 by which the top ring 63 is rotatably supported. The magnetic bearing 71 comprises an electromagnet whose magnetically attractive forces are controlled to keep the top ring 63 in a levitated position out of physical contact with the magnetic bearing 71. The top ring 63 is thus magnetically held in a constant position regardless of disturbances applied thereto. Accordingly, the top ring 63 is prevented from being unduly vibrated by disturbances. The top ring 63 has an upper end 63*a* connected to a pressure transmitting beam 65*a* connected to the pressing cylinder 67 in the support post 66. The magnetic bearing 71 imparts rotating forces to the top ring 63 out of contact therewith. The semiconductor wafer 4 held by the top ring 63 is polished by the rotation of the grinding plate or polishing pad 61, the rotation of the semiconductor wafer 4, and the pressure applied from the pressing cylinder 67 to the semiconductor wafer 4. Vibrations transmitted from the semiconductor wafer 4 to the top ring 63 are suppressed by the magnetic bearing 71.

The conventional polishing apparatus have had a spline shaft, a top ring arm, a swing shaft, and other parts supporting the top ring, and those parts have been designed for large rigidity in order to suppress vibrations developed in the polishing apparatus. Therefore, the conventional polishing apparatus have been very heavy and large in size. According to the present invention, however, since the holder for holding the workpiece to be polished is rotatably supported by the bearing, the holder is prevented from being unduly vibrated. Therefore, various shafts and arms associated with the workpiece holder are not required to be highly rigid, and the polishing apparatus can thus be reduced in weight and made compact.

In the above embodiments, the holder for holding the workpiece to be polished is rotatably supported at its outer circumferential surface by the bearing for suppressing vibrations transmitted thereto. In the cup-type or scrolling-type polishing apparatus, the holder which holds the grinding plate or polishing pad may be rotatably supported at its outer circumferential surface by a bearing for suppressing vibrations transmitted thereto.

Although certain preferred embodiments of the present invention have been shown and described in detail, it should be understood that various changes and modifications may be made thereto without departing from the scope of the appended claims.

What is claimed is:

1. A polishing apparatus comprising:

a mount base;

a turntable mounted on said mount base, said turntable having a polishing surface;

a top ring to hold a workpiece to be polished and to press the workpiece against said polishing surface under a predetermined pressure to polish the workpiece to a planar mirror finish, said top ring having an upper surface connected to a drive shaft, said top ring having a lower surface having a holding region to hold the workpiece, and said top ring having an outer circumferential surface;

a bearing rotatably supporting said outer circumferential surface of said top ring; and a support mechanism fixing said bearing to said mount base.

2. An apparatus as claimed in claim 1, further comprising a bearing casing housing therein said bearing, and wherein said bearing casing is fixed to said mount base by said support mechanism.

3. An apparatus as claimed in claim 1, wherein said top ring comprises a top ring body, a cylindrical guide ring disposed on an outer circumferential surface of said top ring body, and keys coupling said guide ring to said top ring body such that said guide ring is axially movable relative to said top ring body and such that said guide ring is fixed circumferentially with said top ring body.

4. An apparatus as claimed in claim 3, wherein said bearing includes an inner race mounted on an outer circumferential surface of a member rotatably relative to said guide ring, and an outer race mounted on an inner circumferential surface of a fixed member fixed to said support mechanism.

5. An apparatus as claimed in claim 3, further comprising a vibration damper between said top ring body and said guide ring.

6. A polishing apparatus for polishing a workpiece to a planar mirror finish by pressing the workpiece against a polishing surface while imparting a relative sliding motion between the workpiece and the polishing surface, said apparatus comprising:

a rotatable holding member to hold the workpiece, said holding member having an outer circumferential surface; and a bearing supporting said outer circumferential surface of said holding member to suppress vibrations from being transmitted to said holding member when the workpiece is being polished.

7. An apparatus as claimed in claim 6, further comprising an abrasive member defining the polishing surface, said polishing surface facing upwardly, and wherein said holding member holds the workpiece with a surface thereof to be polished facing downwardly against said polishing surface and rotates the workpiece, thereby to polish the surface of the workpiece.

8. An apparatus as claimed in claim 7, further comprising a drive for imparting a scrolling motion to said abrasive member.

9. An apparatus as claimed in claim 6, wherein said holding member holds the workpiece with a surface thereof to be polished facing upwardly, and further comprising an abrasive member defining said polishing surface, said polishing surface facing downwardly, and means for imparting to said abrasive member at least one of a rotating motion and a reciprocating motion.

10. An apparatus as claimed in claim 6, wherein said bearing comprises a magnetic bearing.

* * * * *